US007143901B1

(12) United States Patent
Groves

(10) Patent No.: US 7,143,901 B1
(45) Date of Patent: Dec. 5, 2006

(54) ADJUSTABLE RACK FOR A STONE SLAB

(76) Inventor: Henry R. Groves, 3026 Fox Ct., Prairie Grove, IL (US) 60012

( * ) Notice: Subject to any disclaimer, the term of this patent is extended or adjusted under 35 U.S.C. 154(b) by 147 days.

(21) Appl. No.: 10/912,716

(22) Filed: Aug. 5, 2004

(51) Int. Cl.
*B65D 85/48* (2006.01)

(52) U.S. Cl. ..... 211/41.14; 211/41.15; 211/189; 206/449; 206/454; 125/35

(58) Field of Classification Search ..... 211/41.14, 211/41.1, 41.15, 41.16; 206/595, 596, 449, 206/454; 125/35
See application file for complete search history.

(56) References Cited

U.S. PATENT DOCUMENTS

| | | | | |
|---|---|---|---|---|
| 65,279 | A | 5/1867 | Rogers | |
| 292,361 | A | 1/1884 | Rife | |
| 293,942 | A | 2/1884 | Brounscombe | |
| 647,074 | A | 4/1900 | Butterfield | |
| 980,878 | A | 1/1911 | Mistin | |
| 2,039,927 | A | 5/1936 | Poglein | |
| 2,066,594 | A * | 1/1937 | Watson | 294/67.1 |
| 2,291,197 | A | 7/1942 | Adorney | |
| 2,946,453 | A * | 7/1960 | Pityo | 211/41.14 |
| 3,261,616 | A | 7/1966 | Mason | |
| 3,589,525 | A * | 6/1971 | Allen | 211/162 |
| 3,804,033 | A * | 4/1974 | Izawa et al. | 108/53.5 |
| 3,863,900 | A | 2/1975 | Dagiel et al. | |
| 4,014,435 | A * | 3/1977 | Rowley et al. | 206/386 |
| 4,033,597 | A * | 7/1977 | Boyer | 280/46 |
| 4,093,251 | A | 6/1978 | Boyer | |
| 4,178,468 | A | 12/1979 | Jorgensen et al. | |
| 4,368,822 | A * | 1/1983 | Kramer et al. | 211/85.8 |
| 4,512,473 | A * | 4/1985 | Thomaswick et al. | 206/454 |
| 4,778,064 | A | 10/1988 | Gold | |
| 5,193,692 | A * | 3/1993 | Farley et al. | 211/41.14 |
| 5,465,883 | A | 11/1995 | Woodward | |
| 5,505,574 | A | 4/1996 | Piazza | |
| 5,542,805 | A | 8/1996 | Lisec | |
| 5,779,063 | A | 7/1998 | Moran, III | |
| 5,850,924 | A * | 12/1998 | Borter | 211/41.14 |
| 5,884,778 | A | 3/1999 | Freiheit | |
| 6,648,572 | B1 | 1/2002 | Piazza | |
| 6,450,514 | B1 | 9/2002 | Ronca | |
| 6,457,619 | B1 | 10/2002 | Werner et al. | |
| 6,591,988 | B1 * | 7/2003 | Trpkovski | 206/454 |
| D497,776 | S * | 11/2004 | Berger et al. | D7/601 |
| D509,108 | S * | 9/2005 | Rosenberg et al. | D7/601 |
| 2003/0183590 | A1 | 10/2003 | Chubb | |

* cited by examiner

*Primary Examiner*—Richard E. Chilcot, Jr.
*Assistant Examiner*—Jared W. Newton
(74) *Attorney, Agent, or Firm*—Mathew RP Perrone Jr.

(57) ABSTRACT

An adjustable rack for a stone slab or plate glass has a base with adjustable poles positioned on the base, with the base also having a durable wood strip secured therein in order to support the stone slab thereon. Two adjustable racks are preferred for at least one stone slab. Three adjustable racks are preferred for at least one sheet of plate glass.

9 Claims, 4 Drawing Sheets

ADJUSTABLE RACK FOR A STONE SLAB

This invention relates to an adjustable rack for a stone slab, and more particularly, to an adjustable rack for a stone slab, which includes a wooden support partially mounted within a slot in the rack.

BACKGROUND OF THE INVENTION

With the increased popularity of stone slabs for both decorative and utilitarian purposes, it has become advantageous to store the slabs in an efficient, useful structure which provides both access and efficiency of storage. The very weight of the stone slabs causes problems with such access and storage.

It becomes extremely desirable to store the stone slabs in a proper fashion, which maintains access to the slabs, while also providing safe storage. The very hardness of stone slabs mitigates against the proper storage thereof. If the stone slab contacts a hard surface, damage may be done to the slab. If the stone slab contacts a soft surface, the roughness of the edge of the slab mitigates against moving that slab smoothly over that soft surface.

Thus, it is quite useful to provide a storage rack for at least one stone slab. Such a slab has substantial weight. That weight greatly complicates storage and handling. With the complicated storage and handling of the stone slabs, it is, nevertheless, desirable to have a durable rack capable of resisting the stress placed thereon by the heavy stone slabs.

A rack supporting heavy stone slabs or at least one sheet of plate glass, which is also heavy, has difficult requirements. In the first place, such a rack must be strong enough to support the weight. Secondly, such a rack must not cause damage to whatever is resting thereon. To achieve strength, it is common to use a metal rack. However, the metal can damage the item resting thereon.

Glass sheets or at least one sheet of plate glass can also be heavy. For example, a large stone slab may easily weigh more than 500 kilograms. A large glass sheet may easily weigh more than 250 kilograms. Such weight can greatly complicate storage of either.

Various pads designed to achieve the metal strength, while minimizing damage to the items of glass or metal resting thereon can cause difficulty. Such a pad must be supportive, resist damage and be held in place efficiently. These functions are contradictory in that maximization of one desired property will cause the interference of the other desired properties. Clearly, a solution to these problems can provide great advantages.

SUMMARY OF THE INVENTION

Among the many objectives of this invention is the provision of an adjustable rack for a stone slab, which permits a stone slab to be used in an efficient fashion.

A further objective of this invention is the provision of an adjustable rack for a stone slab, which prevents damage to a stone slab.

Yet a further objective of this invention is the provision of an adjustable rack for a stone slab, which supports a stone slab.

A still further objective of this invention is the provision of an adjustable rack for a stone slab, which is easily installed.

Another objective of this invention is the provision of an adjustable rack for a stone slab, which is durable.

Yet another objective of this invention is the provision of an adjustable rack for a stone slab, which has a supportive pad.

Still, another objective of this invention is the provision of an adjustable rack for a stone slab, which resists damage from the slab.

Also, an objective of this invention is the provision of an adjustable rack for a heavy sheet of material, which resists damage from the material.

A further objective of this invention is the provision of an adjustable rack for a heavy sheet of material, which prevents damage to the material.

Yet a further objective of this invention is the provision of an adjustable rack for a heavy sheet of material, which supports the material.

A still further objective of this invention is the provision of an adjustable rack for a heavy sheet of material, which is easily installed.

Another objective of this invention is the provision of an adjustable rack for at least one sheet of plate glass.

These and other objectives of the invention (which other objectives become clear by consideration of the specification, claims and drawings as a whole) are met by providing an adjustable rack for a stone slab having a base with adjustable poles positioned on the base, with the base also having a durable wood strip secured therein in order to support the stone slab thereon.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

With an adjustable rack assembly of this invention, very heavy flat items may be supported in a safe fashion. Such items include, but are not limited stone slabs and plate glass.

The adjustable rack assembly has an elongated base adapted to receive a plurality of vertical poles. The elongated base includes a plurality of apertures for receiving vertical poles. Each aperture may receive one vertical pole. The plurality of apertures provides for moving each pole and adapting to the thickness of the glass sheet or stone slab.

Within or on the elongated base, is wear strip or support base. This support is usually formed of wood and has the major contact with whatever heavy flat item is placed thereon. The wood is especially useful with the stone slabs, because the wood supports the slab while at least minimizing, if not eliminating, damage to the adjustable rack assembly.

Figure 1:
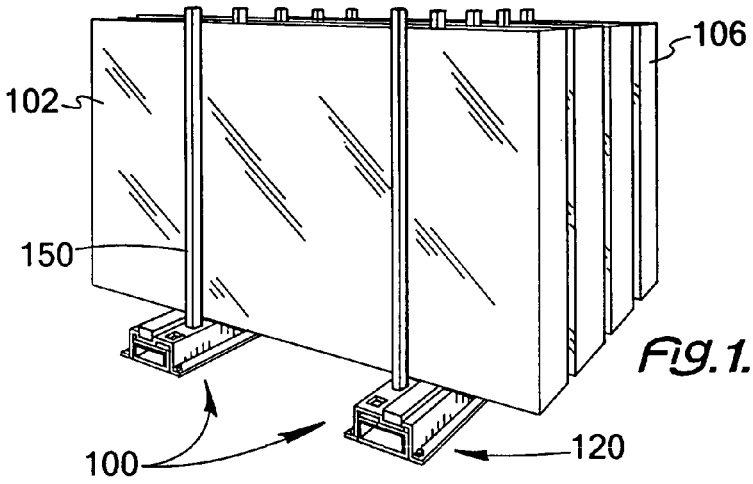
FIG. 1 depicts a perspective view of a pair of adjustable rack assemblies 100, having stone slabs 102 thereon.
Figure 2:
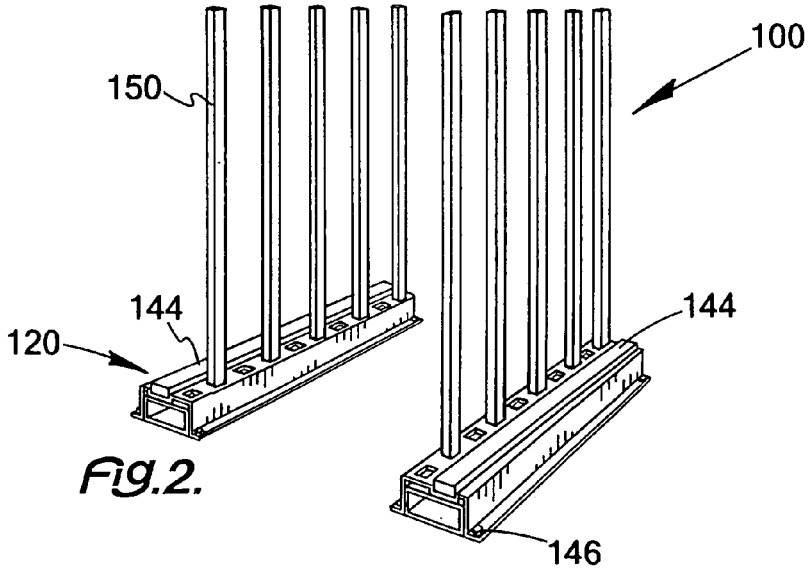
FIG. 2 depicts a perspective view of a pair of adjustable rack assemblies 100 based on FIG. 1, with stone slabs 102 removed.
Figure 6:
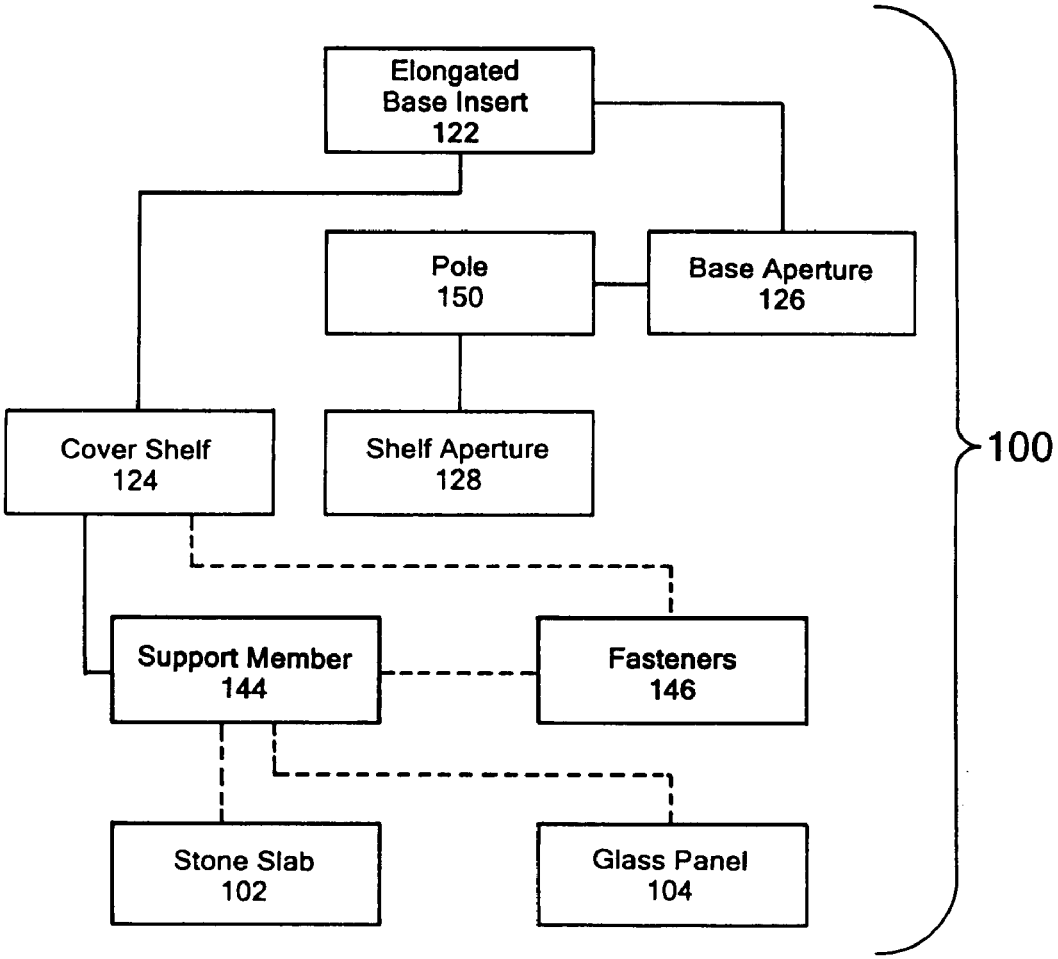
FIG. 6 depicts a block diagram of the adjustable rack assembly 100.

Referring now to FIG. 1 and FIG. 2, a pair of adjustable rack assemblies 100 have stone slabs 102. The adjustable rack assemblies 100 have a support base 120, into which are inserted poles 150, which in turn support stone slabs 102. Each stone slab 102 rests on two of support base 120 between two pair of poles 150. Each pair of poles 150 on support base 120 can receive stone slab 102 at slab edge 106 thereof. Support member 144 is secured in support base 120 by friction or fasteners 146 (FIG. 6). Fasteners may be screws, nuts and bolts, nails or other suitable fasteners.

Figure 3:
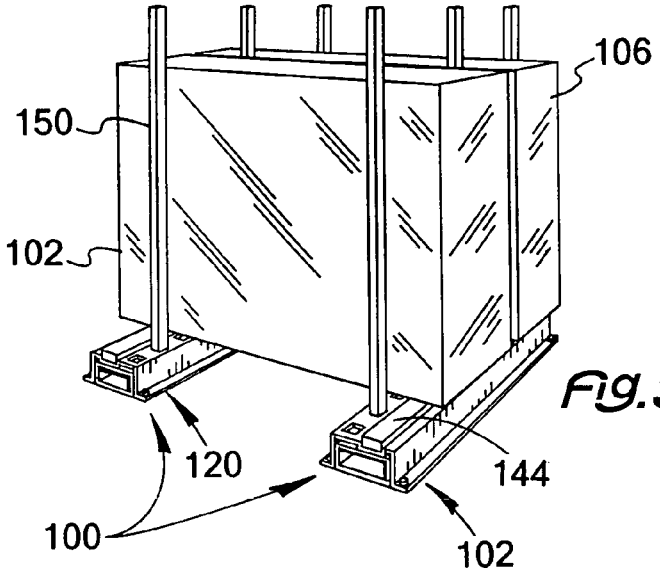
FIG. 3 depicts a second perspective view of a pair of adjustable rack assemblies 100, having stone slabs 102 thereon.
Figure 4:
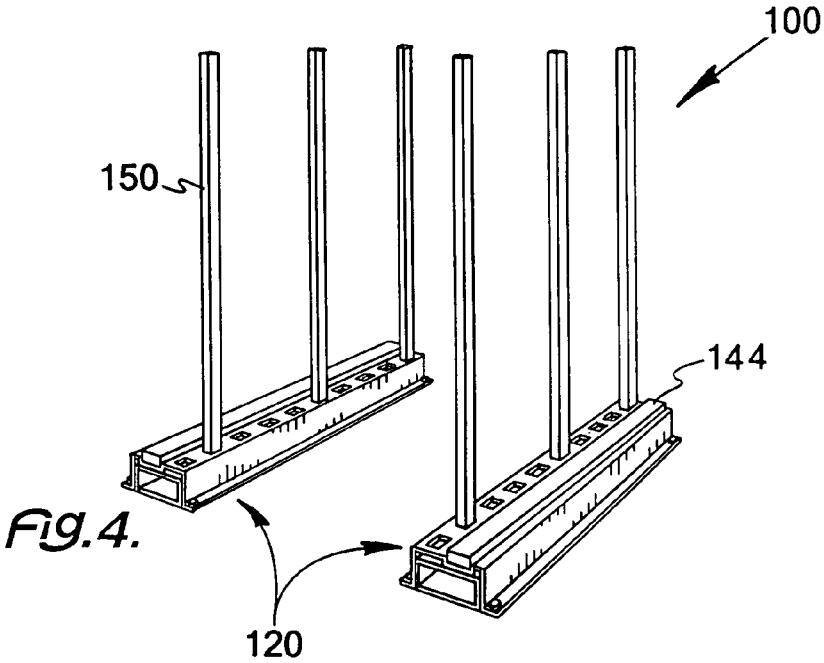
FIG. 4 depicts a perspective view of a pair of adjustable rack assemblies 100 based on FIG. 3, with stone slabs 102 removed.

FIG. 3 and FIG. 4 are similar to FIG. 1 and FIG. 2, but differ in the respect that fewer pairs of poles 150 are present so that thicker versions of stone slab 102 may be stored thereon. In a like fashion, each stone slab 102 rests on two of support base 120 between two pair of poles 150. Each pair of poles 150 on support base 120 can receive stone slab 102 at slab edge 106 thereof.

Figure 5:
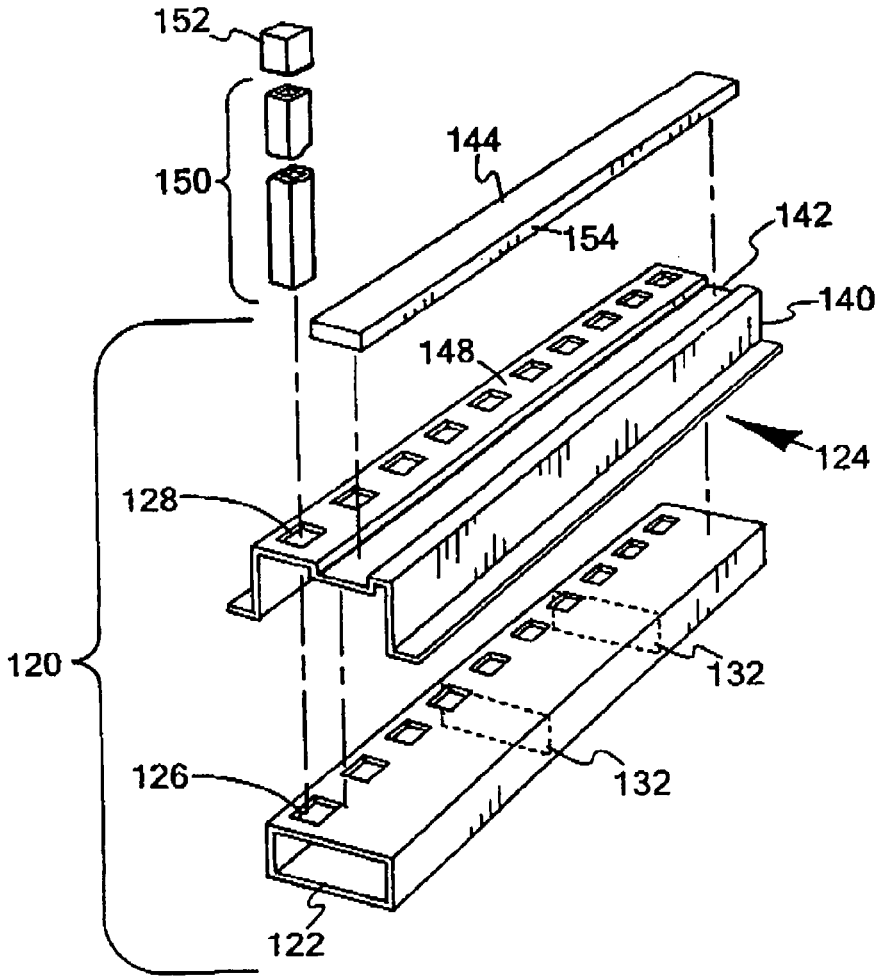
FIG. 5 depicts an exploded, perspective view of the adjustable rack assembly 100.

Adding FIG. 5 to the consideration, the structure of adjustable rack assembly 100 becomes more clear. Support base 120, with elongated base insert 122, receives a shaped cover shelf 124 also in FIG. 6. Elongated base insert 122 includes a plurality of base apertures 126. In like fashion, the shaped cover shelf 124 (FIG. 6) has a plurality of shelf apertures 128.

Wherever a pole 150 is placed in support base 120, a base aperture 126 is aligned with a shelf aperture 128. Clearly, base aperture 126 and shelf aperture 128 are substantially congruent in order to receive a pole 150.

Elongated base insert 122 is preferably hollow with a plurality of gussets 132 welded or otherwise secured therein as bracing members or support members. In this fashion, elongated base insert 122 may be both hollow and strong enough to support stone slab 102 (FIG. 1).

Shaped cover shelf 124 (FIG. 6) receives elongated base 122 in a female to male relationship with an appropriate alignment of each base aperture 126 with a shelf aperture 128. Within shaped cover shelf 124, is an elongated channel 140, which is substantially parallel to the common axis 142 of the series of shelf apertures 128. Elongated channel 140 receives a support member 144, such as a piece of wood. Support member 144 is frictionally secured in the elongated channel 140. Additionally, fasteners 146 (FIG. 6) may buttress the security of support member 144 in elongated channel 140.

Support member 144 substantially fills elongated channel 140, and extends above cover surface 148. In this fashion, stone slab 102 is supported on, but has minimal or no contact with shaped cover shelf 124. Stone slab 102 contacts only support member 144.

Preferably, support member 144 has up to about fifty (50%) percent of its thickness 154 above cover surface 140. More preferably, support member 144 has about five (5%) to about forty five (45%) percent of its thickness 154 above cover surface 140. Most preferably, support member 144 has about ten (10%) to about forty (40%) percent of its thickness 154 above cover surface 140.

Rubber pole cover 152 securely fits over the end of pole 150. Rubber pole cover 152 serves to protect stone slab 102 or glass panel 104 (FIG. 6) from scratching should it contact a metallic pole 150.

With the further consideration of FIG. 6, a variety of structures and uses for adjustable rack assembly 100 become clear. For example, two of adjustable rack assembly 100 support stone slab 102, three of adjustable rack assembly 100, support glass panel 104.

Pole 150 may have any suitable shape, which may be placed in the appropriate aligned and shaped base aperture 126 and shelf aperture 128. Clearly, base aperture 126 and shelf aperture 128 are substantially congruent in order to receive a pole 150.

Pole 150 may have a polygonal cross-section or a arcuate cross-section. The polygonal cross-section for pole 150 may have any number of sides. A desirable number of sides is 3 to about 10. Preferably, a polygonal cross-section for pole 150 is rectangular or square. The arcuate cross-section may be circular or elliptical. Base aperture 126 is adjusted appropriately to fit pole 150.

Elongated base insert 122 is preferably hollow with a plurality of gussets 132 (FIG. 5) welded or otherwise secured therein as bracing members. However, elongated base insert 122 may be solid if desired. Likewise gussets 132 may be solid or rectangular with buttressed or triangulated corners.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. An adjustable rack for supporting and storing a heavy sheet of material having a base with at least two poles positioned on the base, comprising:

(a) the base being elongated;

(b) the base having a durable strip secured therein in order to support the heavy sheet of material thereon;

(c) the base having at least one pole aperture for receiving each of the at least two poles;

(d) the base being a support base with an elongated base insert having a shaped cover shelf thereover;

(e) the elongated base insert including at least one base aperture;

(f) the shaped cover shelf including at least one shelf aperture to match each of the at least one pole aperture;

(g) the durable strip extending the length of the elongated base;

(h) the at least one base aperture aligning with the at least one shelf aperture in order to form the at least one pole aperture;

(i) the elongated base insert having at least one gusset secured therein;

(j) the elongated base insert being hollow;

(k) the shaped cover shelf having an elongated channel;

(l) the elongated channel receiving a support member for supporting the heavy sheet of material;

(m) the at least one gusset reinforcing the elongated base insert;

(n) the support member substantially filling the elongated channel;

(o) the shaped cover shelf including a cover surface;

(p) the support member having a thickness; and (q) the thickness extending above the cover surface in order to at least minimize contact of heavy sheet of material with the cover surface.

2. The adjustable rack of claim 1 further comprising:

(a) the support member being secured in the elongated channel by friction;

(b) the support member serving as a primary contact with the heavy sheet of material; and (c) the durable strip being wood used as the support member.

3. The adjustable rack of claim 1 further comprising:

(a) the support member being secured in the elongated channel by at least one fastener;

(b) the support member serving as a primary contact with the heavy sheet of material;

(c) the durable strip being wood used as the support member; and (d) two of the adjustable racks being used jointly and adapted to support the heavy sheet of material.

4. The adjustable rack of claim 1 further comprising:

(a) the at least one pole being received by the at least one pole aperture at a first end;

(b) the at least one pole having a second end oppositely disposed from the first end; and (c) the second end receiving a rubber pole cover in male to female relationship in order to at least minimize contact of heavy sheet of material with the at least one pole.

5. The adjustable rack of claim 4 further comprising the support member having up to about fifty percent of its thickness above the cover surface.

6. The adjustable rack of claim 5 further comprising:

(a) the support member being secured in the elongated channel by friction; and (b) the support member serving as a primary contact with the heavy sheet of material, (c) the contact of heavy sheet of material being possible with the at least one pole.

7. The adjustable rack of claim 6 further comprising the support member having about five to about forty five percent of its thickness above the cover surface.

8. The adjustable rack of claim 7 further comprising the support member having about ten to about forty percent of the thickness above cover surface.

9. The adjustable rack of claim 8 further comprising the pole having a polygonal shape or an arcuate shape, and the at least one pole aperture being adapted to receive the pole.

* * * * *